US007046203B2

(12) United States Patent
Yuanzhu

(10) Patent No.: US 7,046,203 B2
(45) Date of Patent: May 16, 2006

(54) ANTENNA DEVICE HAVING MINIATURIZED RADIATING CONDUCTOR PLATE

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/983,856

(22) Filed: Nov. 8, 2004

(65) Prior Publication Data

US 2005/0093748 A1 May 5, 2005

(30) Foreign Application Priority Data

Nov. 10, 2003 (JP) ..... 2003-380115

(51) Int. Cl.
*H01Q 1/38* (2006.01)

(52) U.S. Cl. ..... 343/700 MS; 343/846

(58) Field of Classification Search ..... 343/700 MS, 343/702, 846, 848; H01Q 1/38
See application file for complete search history.

(56) References Cited

U.S. PATENT DOCUMENTS 6,255,994 B1 7/2001 Saito
6,897,813 B1 * 5/2005 Higasa ..... 343/700 MS
2004/0021606 A1 * 2/2004 Shigihara ..... 343/700 MS
2005/0024275 A1 * 2/2005 Jo et al. ..... 343/702

FOREIGN PATENT DOCUMENTS

| | | |
|---|---|---|
| DE | 100 55 266 | 5/2002 |
| EP | 1 381 111 | 1/2004 |
| JP | H09-284023 | 10/1997 |
| JP | 2002-237714 | 8/2002 |

OTHER PUBLICATIONS

Copy of search report dated Dec. 22, 2004 for European Patent Application No. EP 04 02 6589.

* cited by examiner

*Primary Examiner*—Hoanganh Le
(74) *Attorney, Agent, or Firm*—Brinks Hofer Gilson & Lione

(57) ABSTRACT

A metal plate patch antenna 10 includes a ground conductor composed of a metal plate, a dielectric substrate placed on and fixed to the ground conductor, a radiating conductor plate composed of a metal plate arranged above the dielectric substrate with a predetermined gap therefrom, leg pieces formed by cutting and raising four places near the outer circumferential portion of the radiating conductor plate toward the dielectric substrate, and a feeding metal piece extending from a feeding point of the radiating conductor plate. Soldering lands are arranged at four corners of the top surface of the dielectric substrate so that lower ends of the leg pieces are respectively soldered to the soldering lands.

2 Claims, 3 Drawing Sheets

ANTENNA DEVICE HAVING MINIATURIZED RADIATING CONDUCTOR PLATE

This application claims the benefit of priority to Japanese Patent Application No. 2003-380115 filed on Nov. 10, 2003, herein incorporated by reference.

BACKGROUND OF THE INVENTION

1. Field of the Invention

The present invention relates to a small antenna device having a patch antenna structure, and more particularly, to an antenna apparatus that is also referred to as a metal plate patch antenna where a radiating conductor plate is composed of a metal plate.

2. Description of the Related Art

Generally, a metal plate patch antenna where a radiating conductor plate is composed of a metal plate has an advantage in that it can be manufactured at a low cost as compared to a patch antenna in which a radiating conductor layer is patterned on one surface of a dielectric substrate. In such a metal plate patch antenna, since the radiating conductor plate is arranged above a ground conductor with an air layer interposed therebetween, the radiating conductor plate is generally supported by a supporting member made of a dielectric material (for example, see Japanese Unexamined Patent Application Publication No. 2002-237714 (page 2, FIG. 6)).

FIG. 6 is a sectional view illustrating an example of a conventional metal plate patch antenna. As shown in FIG. 6, a metal plate patch antenna 1 is made up of a ground conductor 3 patterned on an insulating substrate 2, a radiating conductor plate 4 composed of a metal plate arranged above the ground conductor 3 with a predetermined gap therefrom, and four supporting members 5 made of a dielectric material standing on the ground conductor 3. Four corners of the radiating conductor plate 4 having a substantially square shape are supported by four pillar-shaped supporting members 5. Further, a conductive line 6 is connected to a feeding point of the radiating conductor plate 4. The conductive line 6 is inserted through a through-hole 7 passing through the ground conductor 3 and insulating substrate 2 to connect to an antenna circuit (not shown). In the metal plate patch antenna 1 having the above-mentioned structure, since the supporting members 5 made of a dielectric material are interposed between the ground conductor 3 and an outer circumferential portion of the radiating conductor plate 4 which has an intensive electric field, the size of the radiating conductor plate 4 can be decreased by using a wavelength shortening effect by a dielectric material.

The above-mentioned conventional metal plate patch antenna 1 has an advantage in that the size of the radiating conductor plate 4 can be deceased. However, there is a problem because the antenna efficiency deteriorates from the dielectric loss caused by the supporting member 5. Further, in the conventional metal plate patch antenna 1, since four supporting members 5 made of a dielectric material are interposed between the ground conductor 3 and the radiating conductor plate 4, the material and assembling cost are increased, so that the antenna cannot be manufactured at a low cost.

SUMMARY OF THE INVENTION

Accordingly, the present invention has been made to solve the above-mentioned problems, and it is an object of the present invention to provide a metal plate patch antenna in which the size of a radiating conductor plate can be decreased to reduce dielectric loss and the antenna can be manufactured at a low cost.

In order to achieve the above-mentioned object, according to a first aspect of the present invention, there is provided an antenna device comprising: a dielectric substrate provided on a ground conductor; a plurality of soldering lands arranged on the dielectric substrate; a radiating conductor plate composed of a metal plate arranged above the dielectric substrate with a predetermined gap therefrom; and a plurality of leg pieces formed by folding back a plurality of places excluding the central portion of the radiating conductor plate toward the dielectric substrate. The plurality of leg pieces is soldered to the corresponding soldering lands to support the radiating conductor plate.

In the antenna device (metal plate patch antenna) having the above-mentioned structure, the leg pieces that extend from the radiating conductor plate to the dielectric substrate are placed on and soldered to the soldering lands. Since the soldering lands face the ground conductor via the dielectric substrate, additional capacitance is generated between the soldering lands and the ground conductor. Therefore, the resonant frequency of the radiating conductor plate becomes lower and the size of the radiating conductor plate can be decreased. Further, if an air layer with a predetermined thickness is interposed between the radiating conductor plate and the ground conductor, the dielectric substrate may be composed of a thin plate for generating additional capacitance. As a result, a relatively inexpensive dielectric substrate can be used and the influence due to dielectric loss can be drastically suppressed. In addition, since the resonant frequency varies according to the size or arrangement of the plurality of soldering lands, fine adjustment of the resonant frequency can be easily performed or the bandwidth of the resonant frequency can easily become wider.

According to a second aspect of the present invention, the ground conductor is composed of a metal plate larger than the radiating conductor plate, and the dielectric substrate smaller than the radiating conductor plate is placed on the ground conductor. As a result, since the ground conductor composed of an inexpensive metal plate such as a steel plate and an expensive dielectric substrate smaller in size than the radiating conductor plate can be used, the manufacturing cost can be drastically decreased.

DESCRIPTION OF THE PREFERRED EMBODIMENTS

Figure 1:
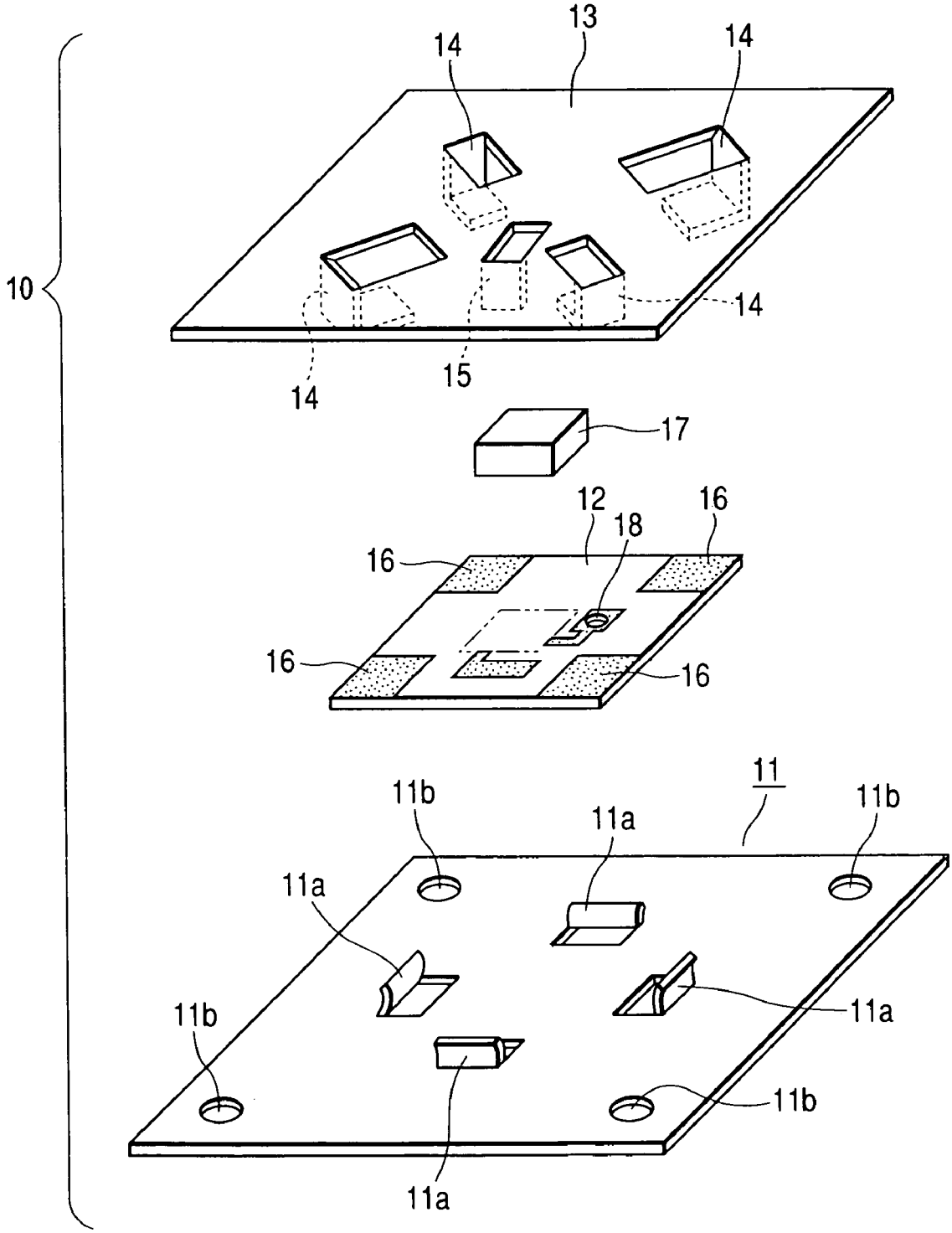
FIG. 1 is an exploded perspective view of a metal plate patch antenna according to a first embodiment of the present invention.
Figure 2:
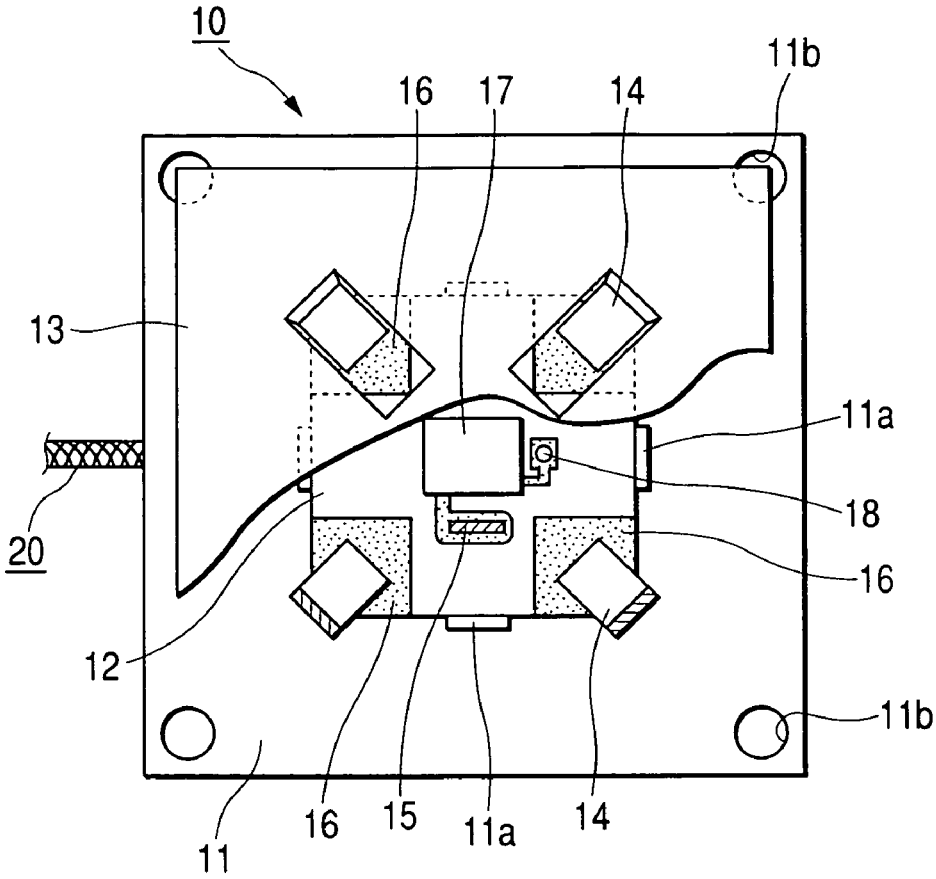
FIG. 2 is a plan view of the metal plate patch antenna according to the first embodiment of the present invention with a part not shown.

Embodiments of the present invention will now be described with reference to the accompanying drawings. FIG. 1 is an exploded perspective view of a metal plate patch antenna according to a first embodiment of the present invention; FIG. 2 is a plan view of the metal plate patch antenna according to the first embodiment of the present invention with a part not shown; and FIG. 3 is a sectional view of the metal plate patch antenna according to the first embodiment of the present invention.

Figure 3:
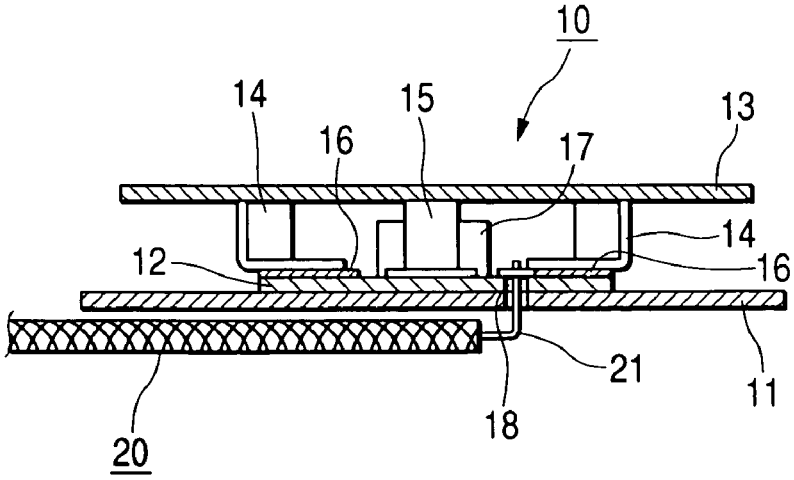
FIG. 3 is a sectional view of the metal plate patch antenna according to the first embodiment of the present invention.

Referring to FIGS. 1 to 3, a metal plate patch antenna 10 comprises a ground conductor 11 composed of a metal plate; a dielectric substrate 12 placed on and fixed to the ground conductor 11; a radiating conductor plate 13 composed of a metal plate arranged above the dielectric substrate 12 with a predetermined gap therefrom; leg pieces 14 formed by cutting and raising four places near the outer circumferential portion of the radiating conductor plate 13 toward the dielectric substrate 12; and a feeding metal piece 15 formed by cutting and raising one place near the center of the radiating conductor plate 13 toward the dielectric substrate 12. An upper end (base end) of the feeding metal piece 15 serves as a feeding point of the radiating conductor plate 13. In addition, since soldering lands 16 are arranged at four corners of the top surface of the dielectric substrate 12 such that lower ends of the leg pieces 14 are respectively soldered to the soldering lands 16, the radiating conductor plate 13 is held at a predetermined height position by the leg pieces 14.

According to the first embodiment, both the ground conductor 11 and the radiating conductor plate 13 are composed of a tin plate (iron plate obtained by plating tin) which has a substantially square shape and a plate thickness of 0.4 mm. However, a side of the radiating conductor plate 13 is set to have 36 mm, while a side of the ground conductor 11 is set to have 40 mm, such that one side of the ground conductor 11 is slightly larger than one side of the radiating conductor plate 13. In the ground conductor 11, four cut and raised pieces 11*a* for locating and fixing the dielectric substrate 12 and mounting holes lib for mounting the ground conductor 11 are provided. In addition, each of the leg pieces 14 for supporting the radiating conductor plate 13 is bent with a substantially L shape and a height of 5 mm. In addition, the gap between the radiating conductor plate 13 and the dielectric substrate 12 is set to a distance of 5 mm.

The dielectric substrate 12 is composed of a substantially square plate made of a dielectric FR-4 and having a plate thickness of 1.0 mm. However, the size of the dielectric substrate 12 is much smaller than the size of the radiating conductor plate 13. One side of the dielectric substrate 12 is set to 20 mm. A bandpass filter 17 is mounted on the center of the top surface of the dielectric substrate 12 and the feeding metal piece 15 is connected to the bandpass filter 17. In addition, as shown in FIG. 3, an inner conductor 21 of a coaxial cable 20 is inserted through a through-hole 18 passing through the ground conductor 11 and the dielectric substrate 12 to connect to the bandpass filter 17. Although not shown, an outer conductor of the coaxial cable 20 is connected to the ground conductor 11.

In the metal plate patch antenna 10 having the above-mentioned structure, the leg pieces 14 that extend from the radiating conductor plate 13 to the dielectric substrate 12 are mounted on and soldered to the corresponding soldering lands 16. However, since the soldering lands 16 face the ground conductor 11 with the dielectric substrate 12 therebetween, additional capacitance is generated between the soldering lands 16 and the ground conductor 11. Therefore, the resonant frequency of the radiating conductor plate 13 is smaller than the case in which the additional capacitance does not exist. This results in a smaller size of the radiating conductor plate 13 necessary for resonating the radiating conductor plate 13 at a specific frequency, thereby achieving a small antenna device. In addition, in the metal plate patch antenna 10, the top surface of the dielectric substrate 12 can be effectively used as a pattern forming surface or a component-mounting surface. Therefore, it is advantageous that the entire antenna device can be made small.

Further, the metal plate patch antenna 10 has an air layer with a thickness of 5 to 6 mm interposed between the radiating conductor plate 13 and the ground conductor 11. The dielectric substrate 12 is composed of a thin plate (having a thickness of 1 mm) for generating additional capacitance. As a result, a relatively inexpensive dielectric material, such as FR-4, can be used such that the manufacturing cost can be decreased, and an influence due to dielectric loss can be decreased such that it is possible to improve antenna efficiency. In addition, the dielectric substrate 12 can be located on and fixed on the ground conductor 11 by using the elasticity of the cut and raised pieces 11*a*. The radiating conductor plate 13 can be stabilized above the dielectric substrate 12 even before the leg pieces 14 are soldered t o the soldering lands 16. Therefore, it is possible to improve the assembling property of the antenna device.

Furthermore, the metal plate patch antenna 10 can suitably adjusts the additional capacitance which varies according to the size or arrangement of the soldering lands 16, and thus results in changing the resonant frequency. Therefore, fine adjustment of the resonant frequency can be easily made or the bandwidth of the resonant frequency can be wider.

In addition, the above-mentioned first embodiment has been described about the case in which the leg pieces 14 protrude from four places of the radiating conductor plate 13 having a substantially square shape and the soldering lands 16 are arranged at four corners of the dielectric substrate 12 is described. The radiating conductor plate 13 or the dielectric substrate 12 may be other shapes such as a circular shape, and the number of the leg pieces 14 or soldering lands 16 may also be suitably selected. However, it is preferable that when the leg pieces 14 protrude from four places near the outer circumferential portion of the radiating conductor plate 13 at almost the same intervals as in the first embodiment, the radiating conductor plate 13 be stabilized by the four leg pieces 14. In addition, when the soldering lands 16 are arranged on the outer circumferential portion of the dielectric substrate 12, the size of the dielectric substrate 12 becomes much smaller than the size of the radiating conductor plate 13. As a result, the material cost can be decreased.

Figure 4:
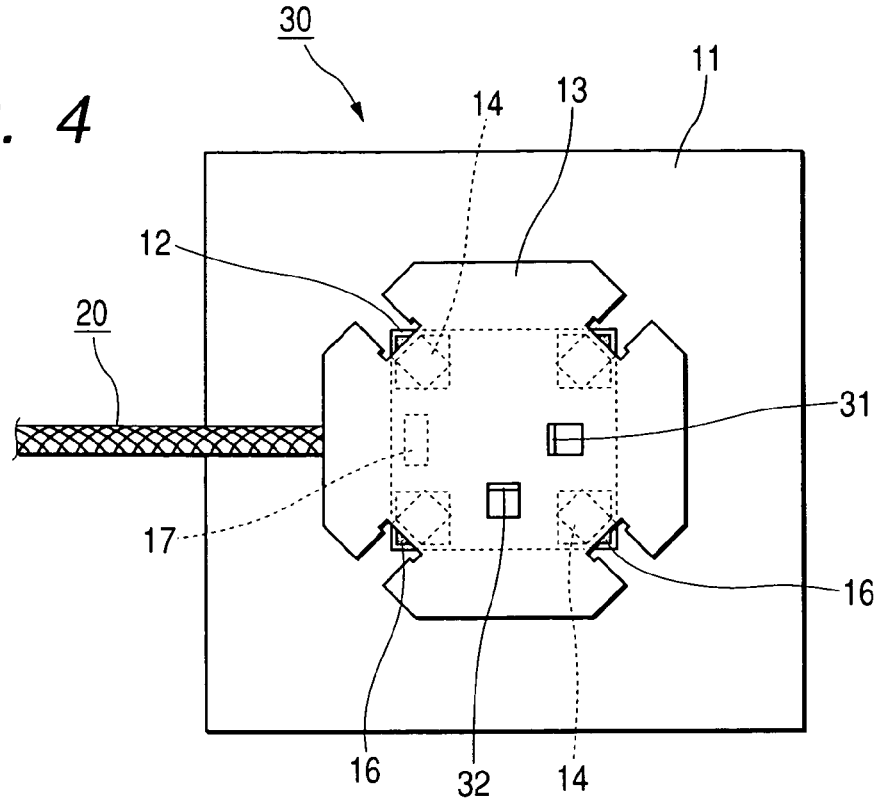
FIG. 4 is a plan view of a metal plate patch antenna according a second embodiment of the present invention.
Figure 5:
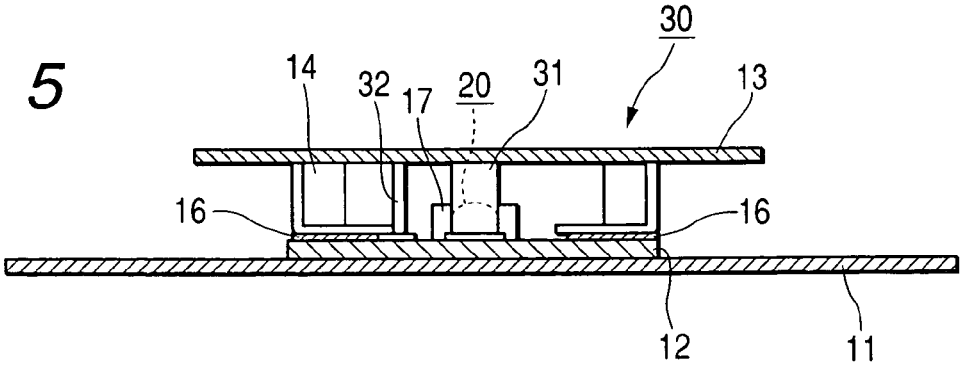
FIG. 5 is a sectional view of the metal plate patch antenna according to the second embodiment of the present invention.
Figure 6:
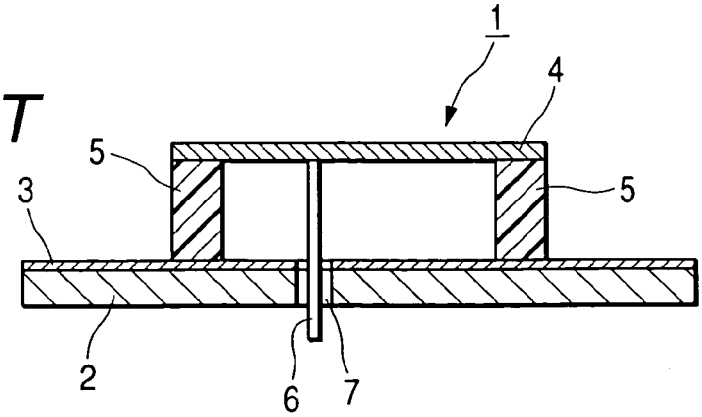
FIG. 6 PRIOR ART
FIG. 6 is a sectional view of a metal plate patch antenna according to a conventional example.

FIG. 4 is a plan view of a metal plate patch antenna according a second embodiment of the present invention, and FIG. 5 is a sectional view of the metal plate patch antenna according to the second embodiment of the present invention. The elements corresponding to those of FIGS. 1 to 3 are denoted by the same reference numerals and the description thereof will be omitted.

In a metal plate patch antenna 30 shown in FIGS. 4 and 5, feeding metal pieces 31 and 32 are formed by cutting and raising two places near the center of a radiating conductor plate 13 toward a dielectric substrate 12. These pieces are connected to an antenna circuit (not shown) so that two-point feeding is achieved. Specifically, the feeding metal pieces 31 and 32 are connected to a bandpass filter 17, and an inner conductor of a coaxial cable 20 is connected to the bandpass filter 17. In addition, in the metal plate patch antenna 30, the shape of the radiating conductor plate 13 is slightly different from the shape of the radiating conductor plate according to the first embodiment. The four corners of the radiating conductor plate 13 are cut and raised so that the cut and raised portions can serve as leg pieces 14.

According to the antenna device (metal plate patch antenna) of the present invention, since the soldering lands on which the leg pieces supporting the radiating conductor plate are soldered face the ground conductor via the dielectric substrate, additional capacitance is generated between the soldering lands and the ground conductor. Consequently, it is possible to achieve a small radiating conductor plate. Since the dielectric substrate with a thin plate thickness and a relatively low cost can be used, the dielectric loss can be suppressed so that it is possible to improve the efficiency of the antenna. In addition, the material cost and the manufacturing cost can be reduced such that the overall cost of the antenna device is much lower.

What is claimed is:

1. An antenna device, comprising:

a dielectric substrate provided on a ground conductor;

a plurality of soldering lands arranged on the dielectric substrate such that the dielectric substrate is disposed between the soldering lands and the ground conductor;

a feeding soldering land disposed on the dielectric substrate and connected to a feeding circuit;

a radiating conductor plate composed of a metal plate arranged above the dielectric substrate with a predetermined gap therefrom; and a plurality of leg pieces and a feeding metal piece formed by folding back a plurality of places excluding a central portion of the radiating conductor plate toward the dielectric substrate, wherein the feeding metal piece is soldered to the feeding soldering land, the plurality of leg pieces is soldered to the corresponding soldering lands to support the radiating conductor plate, and the radiating conductor plate is grounded via a capacitance generated between the plurality of soldering lands and the ground conductor.

2. The antenna device according to claim 1, wherein the ground conductor is composed of a metal plate larger than the radiating conductor plate, and the dielectric substrate smaller than the radiating conductor plate is placed on the ground conductor.

* * * * *